US009539812B2

(12) United States Patent
Wilson et al.

(10) Patent No.: US 9,539,812 B2
(45) Date of Patent: Jan. 10, 2017

(54) FLUID FLOW STRUCTURE

(71) Applicant: HEWLETT-PACKARD DEVELOPMENT COMPANY, L.P., Houston, TX (US)

(72) Inventors: Rhonda Lynn Wilson, Monmouth, OR (US); Daniel D. Dowell, Albany, OR (US)

(73) Assignee: HEWLETT PACKARD DEVLEOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/649,794

(22) PCT Filed: Dec. 14, 2012

(86) PCT No.: PCT/US2012/069749

§ 371 (c)(1),
(2) Date: Jun. 4, 2015

(87) PCT Pub. No.: WO2014/092723

PCT Pub. Date: Jun. 19, 2014

(65) Prior Publication Data

US 2015/0367637 A1 Dec. 24, 2015

(51) Int. Cl.

| | |
|---|---|
| ***B41J 2/14*** | (2006.01) |
| ***B41J 2/16*** | (2006.01) |
| ***B41J 2/155*** | (2006.01) |

(52) U.S. Cl.

CPC ..... *B41J 2/1433* (2013.01); *B41J 2/155* (2013.01); *B41J 2/162* (2013.01); *B41J 2002/14362* (2013.01); *B41J 2002/14419* (2013.01); *B41J 2002/14483* (2013.01); *B41J 2202/19* (2013.01); *B41J 2202/20* (2013.01); *B41J 2202/22* (2013.01)

(58) Field of Classification Search

CPC ..... B41J 2/175; B41J 2/19; B41J 2202/19; B41J 2202/20; B41J 2202/21; B41J 2202/22

See application file for complete search history.

(56) References Cited

U.S. PATENT DOCUMENTS

| | | | |
|---|---|---|---|
| 5,530,463 | A | 6/1996 | Nystrom et al. |
| 7,021,751 | B2 | 4/2006 | Merz et al. |
| 7,086,723 | B2 | 8/2006 | Hara et al. |
| 7,325,914 | B2 | 2/2008 | Yamada et al. |
| 7,399,070 | B2 | 7/2008 | Nakamura et al. |

(Continued)

*Primary Examiner* — Kristal Feggins
*Assistant Examiner* — Kendrick Liu
(74) *Attorney, Agent, or Firm* — HP Inc Patent Department

(57) ABSTRACT

In one example, parts to be assembled into a fluid flow structure include: a first part having flat sealing surfaces each surrounding one of multiple first conduit openings; a second part having sealing ridges each surrounding one of multiple second conduit openings; and a single gasket having multiple holes each surrounded on both sides by a flat sealing surface. Each hole in the gasket is positioned to align with one of the first and second conduit openings so that, when the parts are assembled together, each gasket sealing surface contacts a corresponding one of the flat sealing surfaces on the first part or the sealing ridges on the second part and fluid may flow through the holes in the gasket from the conduit openings on one of the parts to the conduit openings on the other part.

12 Claims, 6 Drawing Sheets

(56) References Cited

U.S. PATENT DOCUMENTS

| | | | | |
|---|---|---|---|---|
| 7,887,165 | B2 | 2/2011 | Okazaki et al. | |
| 8,007,085 | B2 | 8/2011 | Silverbrook et al. | |
| 2005/0284213 | A1* | 12/2005 | Karp | B01L 3/502715 73/61.52 |
| 2006/0170731 | A1* | 8/2006 | Ma | B41J 2/1433 347/44 |
| 2008/0174636 | A1* | 7/2008 | Kim | B41J 2/14024 347/47 |
| 2010/0123762 | A1 | 5/2010 | Freitag et al. | |
| 2012/0019593 | A1 | 1/2012 | Scheffelin et al. | |
| 2012/0212540 | A1 | 8/2012 | Dietl | |
| 2013/0335075 | A1* | 12/2013 | Davis | G01R 33/1215 324/239 |

* cited by examiner

FLUID FLOW STRUCTURE

BACKGROUND

In some inkjet printers, a stationary media wide print bar is used to print on paper or other print media moved past the print bar. Media wide print bars may include multi-part flow structures that provide pathways for ink to flow from the ink supplies to the printheads on the print bar.

DRAWINGS

The same part numbers are used to designate the same or similar parts throughout the figures.

DESCRIPTION

A new multi-part flow structure has been developed for an inkjet print bar to help minimize the forces needed to assemble parts that carry ink to the printheads. Smaller assembly forces result in lower stresses in the assembled parts for better printhead alignment and more reliable gasket seals around the flow passages. In the new flow structure, the sealing surfaces of the gasket surrounding the flow passages are flat and the gasket is sealed by a ridge on one of the parts and a flat on the other part opposite the ridge. The ridge enables a good seal with less assembly force compared to the flat because the sealing pressure is concentrated along a more narrow area. Although the assembly force may be reduced further by a ridge on both mating parts, if there is any misalignment of the parts (and there is always some misalignment of the parts), the misaligned ridges can twist the gasket, causing a significant loss of sealing compression. Accordingly, a ridge on only one part provides a more reliable seal than ridges on both parts.

While examples of the new multi-part flow structure will be described with reference to a print bar for an inkjet printer, the new flow structure is not limited to print bars or even inkjet printing in general but might also be implemented in other structures and devices. The examples shown in the figures and described below, therefore, illustrate but do not limit the invention, which is defined in the Claims following this Description.

A "printhead" as used in this document refers to that part of an inkjet printer or other inkjet type dispenser that expels liquid, for example as drops or streams. "Printhead" and "print bar" are not limited to printing with ink but also include inkjet type dispensing of other liquids and/or for uses other than printing.

Figure 1:
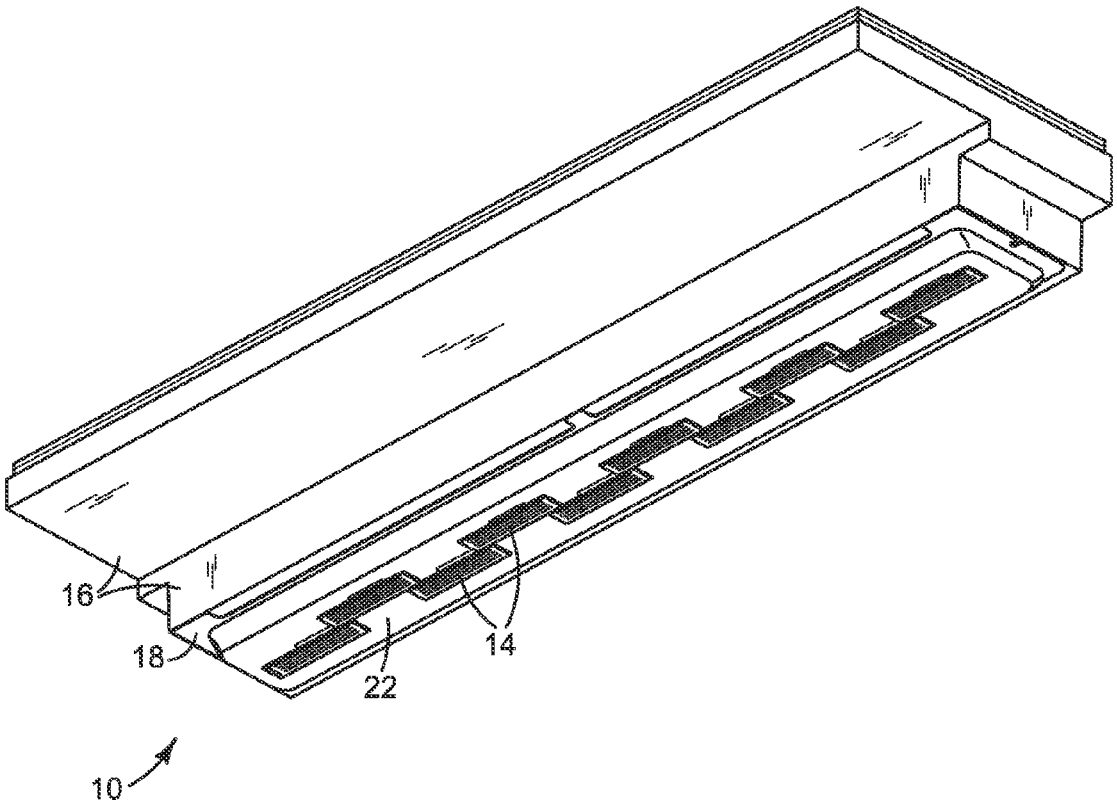
FIGS. 1-3 illustrate a media wide print bar implementing one example of a new multi-part flow structure.
Figure 2:
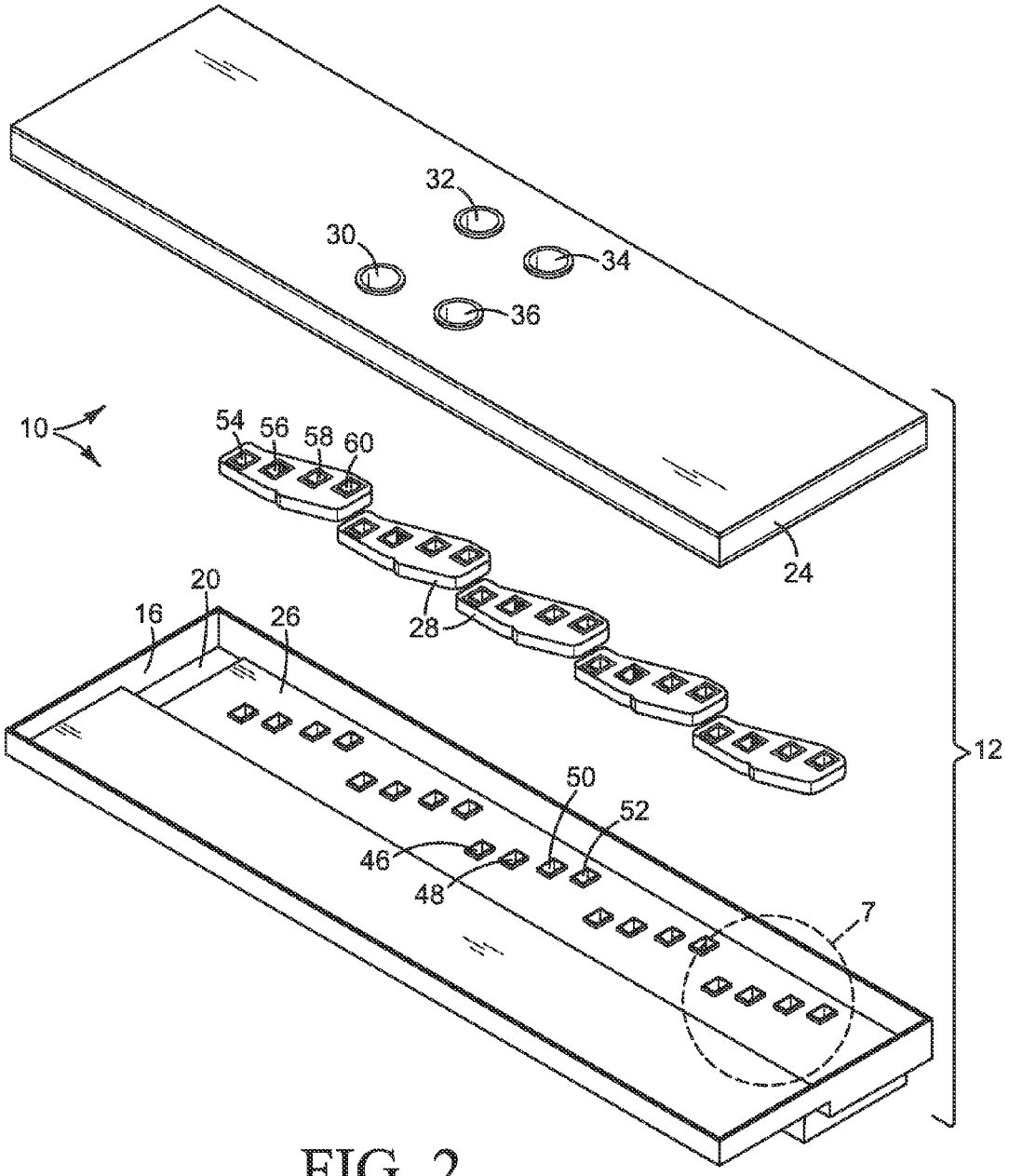
Figure 3:
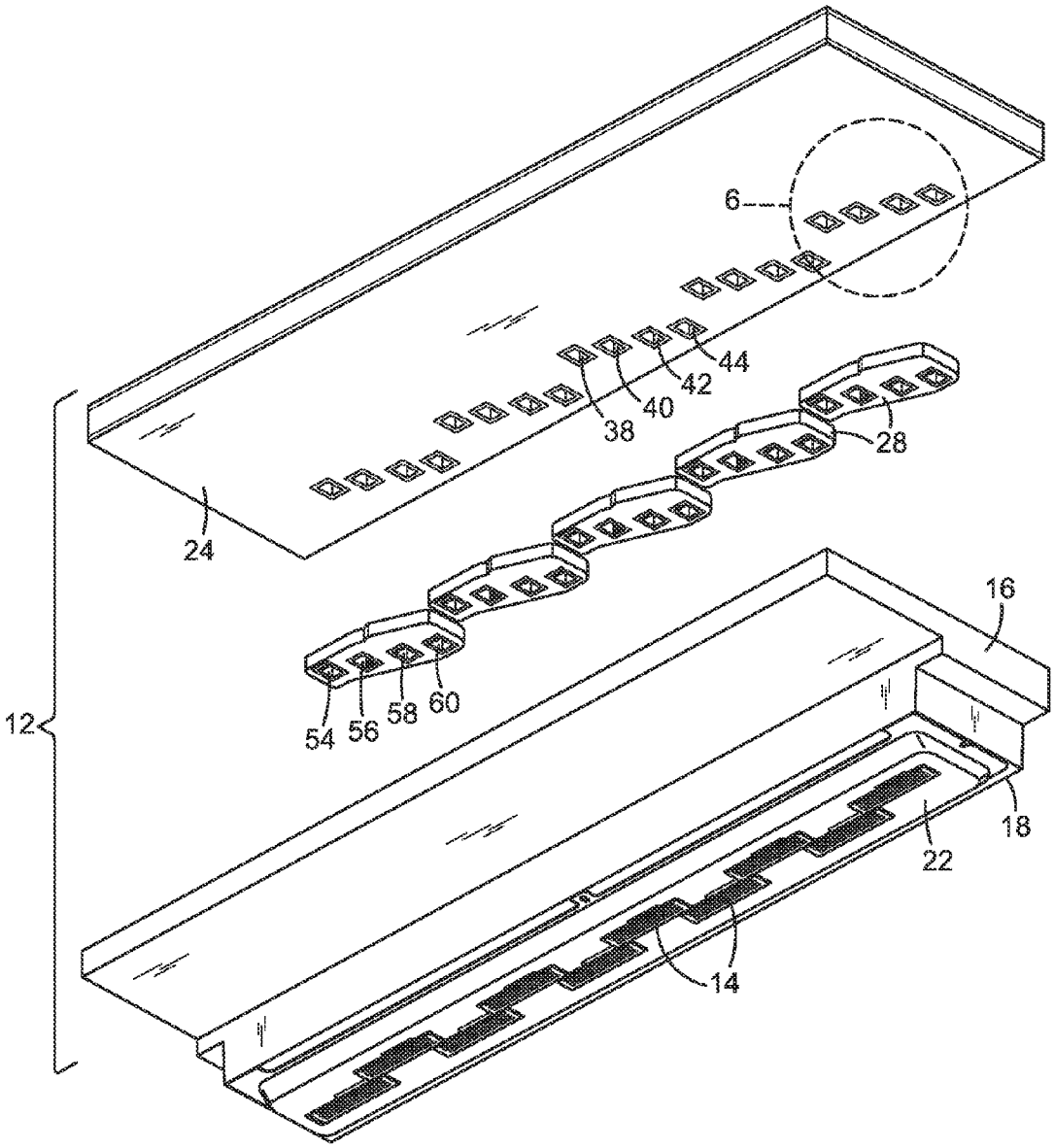

FIGS. 1-3 illustrate a media wide print bar 10 implementing one example of a new multi-part flow structure 12. Referring to FIGS. 1-3, print bar 10 includes multiple printheads 14 mounted to a body 16. In the example shown, printheads 14 are mounted along an exterior part 18 of body 16 and flow structure 12 is supported in an interior tub shaped part 20 of body 16. Exterior body part 18 and tub part 20 may be formed as two (or more) separate parts joined together or they may be integrated into a single part. A shroud 22 extends along the bottom of print bar 10, covering exposed portions of exterior body part 18 and printheads 14 while leaving the face of each printhead 14 exposed for dispensing ink.

Flow structure 12 includes an upper part 24, a lower part 26, and a set of elastomeric or other suitably pliable gaskets 28 sandwiched between parts 24 and 26. Part 24 distributes ink from each of four inlets 30, 32, 34, 36 near the center of part 24 to corresponding outlets 38, 40, 42, 44. For example, each inlet 30-36 receives a different color ink directly or indirectly from an ink supply and distributes that ink to respective outlets 38-44. In the example shown, ink from each inlet 30-36 is distributed to the respective outlet in each of five groups of outlets 38-44 spread across the width of part 24 corresponding to the five printheads 14. Lower part 26 receives ink from upper part 24 through gaskets 28 at inlets 46, 48, 50, 52 and carries the ink to printheads 14, directly or indirectly through another set of flow passages. Again, in the example shown, there are five groups of inlets 46-52 in lower part 26 corresponding to the five groups of outlets 38-44 and the five printheads 14. Other flow configurations are possible. For example, there may be more or fewer groups of inlets and outlets and there need not be a one-to-one correspondence between the number of printheads and the number of groups of inlets and/or outlet.

Figure 4:
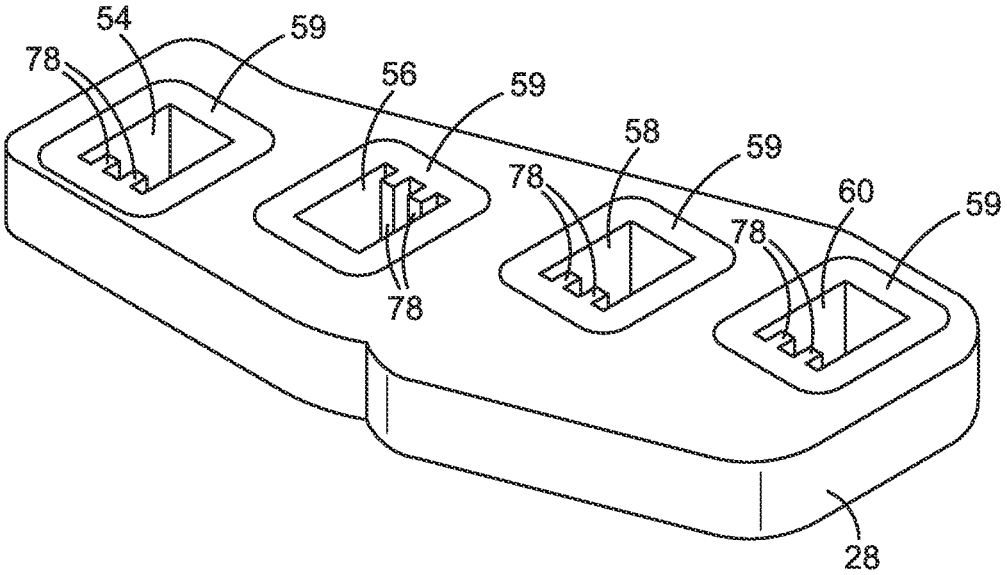
FIGS. 4 and 5 are detail views of one of the gaskets in the print bar flow structure of FIGS. 1-3.
Figure 5:
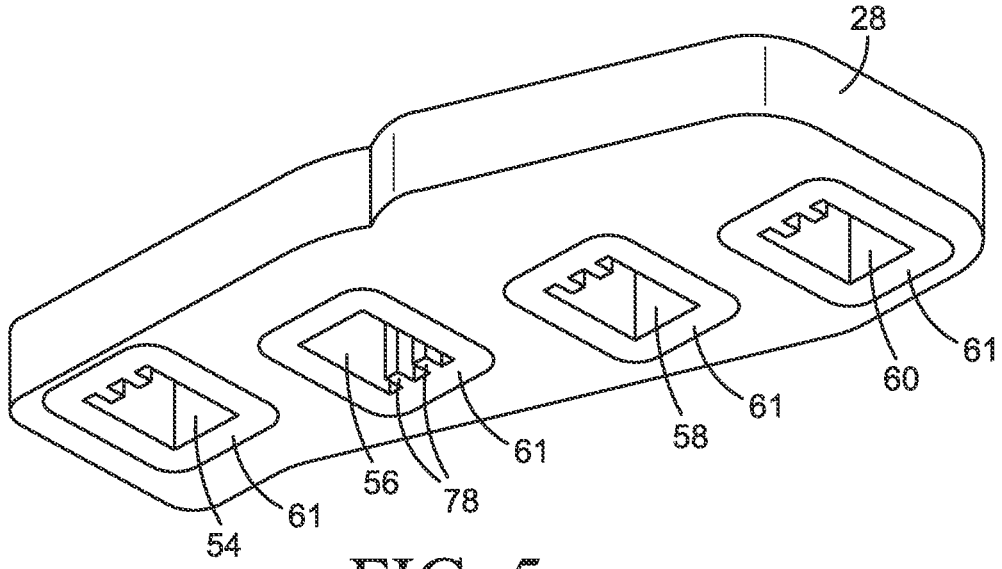
Figure 6:
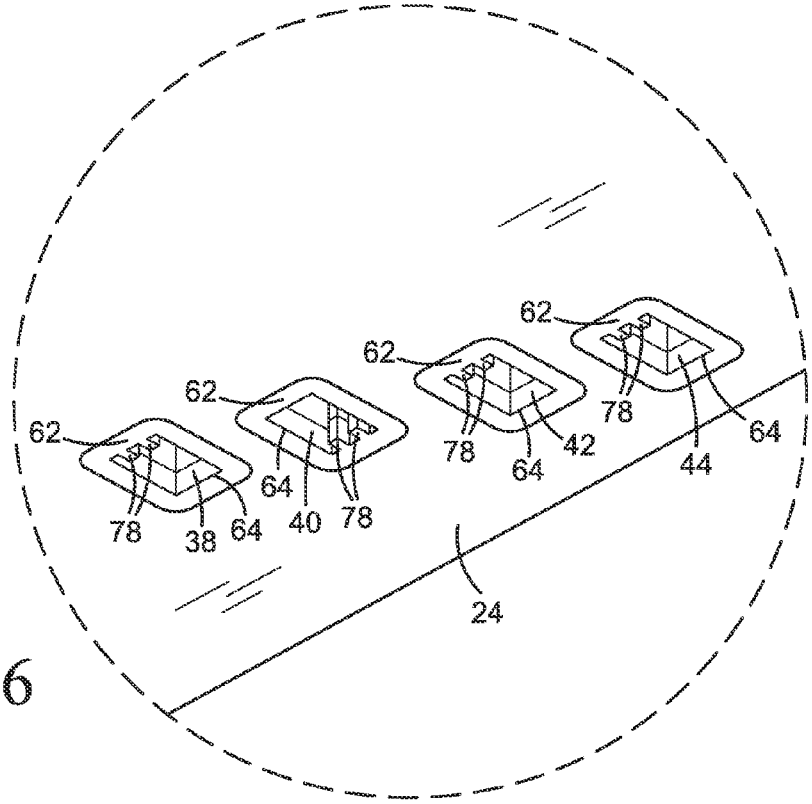
FIGS. 6 and 7 are detail views showing the conduit openings and surrounding gasket sealing surfaces on ink distribution parts in the print bar flow structure of FIGS. 1-3.
Figure 7:
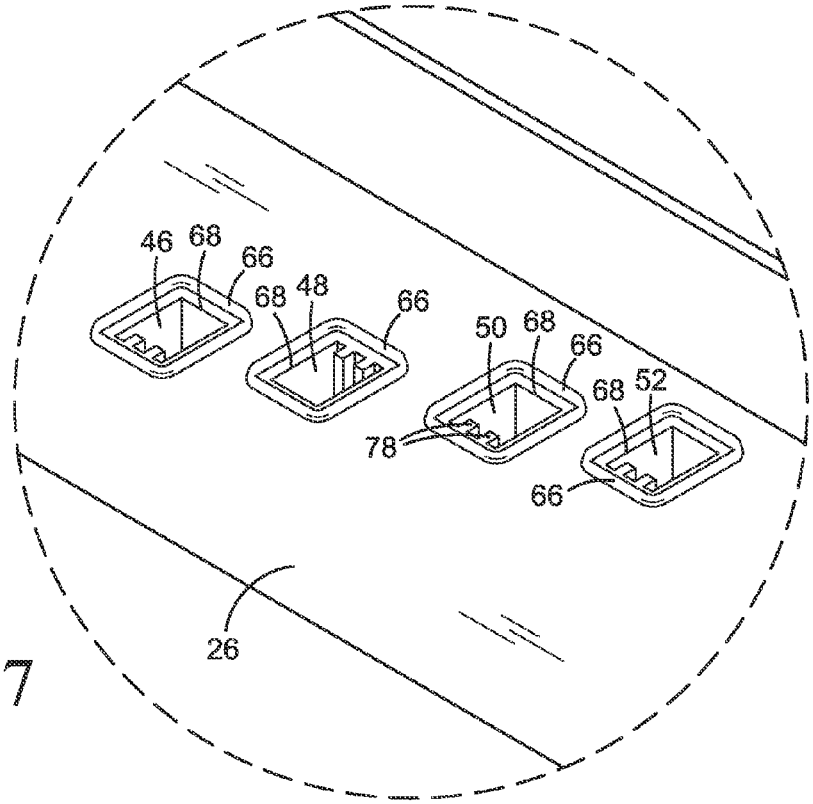

Each gasket 28 includes a set of holes 54, 56, 58, 60 through which ink may pass from outlets 38-44 to inlets 46-52, and each gasket 28 seals the two parts 24, 26 around holes 54-58. As shown in the close-up views of FIGS. 4 and 5, the top and bottom gasket sealing surfaces 59, 61 surrounding holes 54-58 are flat. As shown in the close-up view of FIG. 6, the sealing surface 62 surrounding each outlet 38-44 from a conduit 64 in upper part 24 is flat. As shown in the close-up view of FIG. 7, the sealing surface 66 surrounding each inlet 46-52 to a conduit 68 in lower part 26 is a ridge. As shown in the section view of FIG. 8, which illustrates a joint 70 between parts 24 and 26 along one flow passage 72 (formed by conduits 64, 68 and hole 54), sealing ridge 66 compresses the pliable gasket 28 at sealing surface 61 a predetermined amount, in the range of 10%-40% of gasket thickness for example, to help create and maintain the desired sealing forces between the assembled parts along both flat 62 on part 24 and ridge 66 on part 26.

Figure 8:
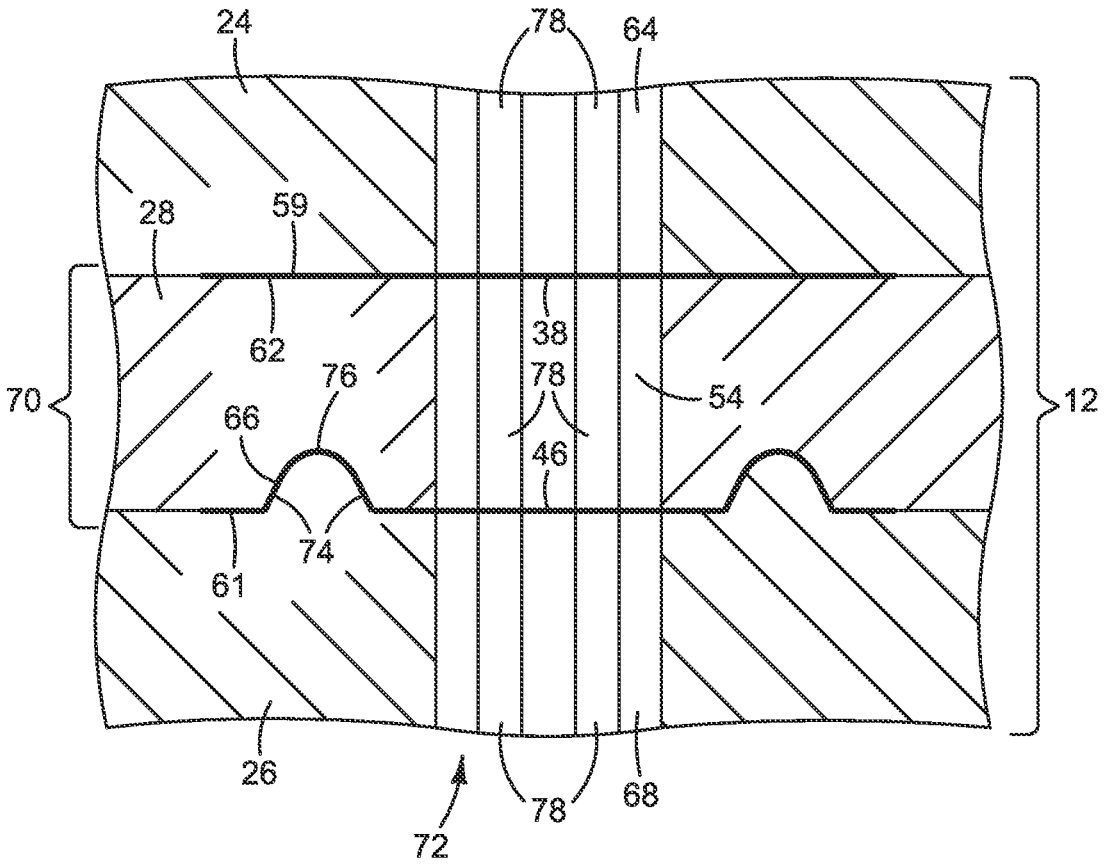
FIG. 8 is a partial section view along one flow conduit at the joint between ink distribution parts in the print bar flow structure of FIGS. 1-3.

In the example shown, as best seen in FIG. 8, each sealing ridge 66 has a triangular base 74 and a rounded apex 76 and each sealing flat 62 spans the apex 76 of the opposing ridge 66. Also, it will usually be desirable to make each sealing flat 62 large enough to cover the full misalignment tolerance between parts 24 and 26 so that each flat 62 will span the corresponding apex 76 even at maximum misalignment. For example, for an assembly misalignment tolerance of 1 mm (per side), typical of molded plastic flow parts 24, 26 in a media wide print bar, sealing flat 62 would be at least 2 mm wide. Although it is expected that a sealing ridge with a rounded profile such as that shown in FIG. 8 will be desirable for most applications of the new flow structure, other suitable ridge profiles are possible. And, while more than one ridge surrounding some or all conduit openings may be used, it is expected that cost and molding limitations usually will favor a single ridge surrounding each conduit opening.

Gasket sealing surface 59 or flat 62, or both, may be polished or otherwise made to a threshold smoothness, less than 32 microinches for example, as necessary or desirable to help ensure a tight seal. Gasket sealing surface 61 might also be made to a threshold smoothness to help improve the seal, although the seal at this joint where the gasket is compressed over the ridge should be less sensitive to surface roughness. One or more ridges or other suitable protrusions 78 in conduits 64, 66 and gasket holes 54-58 form small capillary features that prevent or at least inhibit air bubbles blocking ink flow through vertical flow passages 72.

Using a gasket 28 with a flat sealing surface 61 makes the seal less sensitive to misalignment because ridge 66 on mating part 26 can engage a larger region of gasket 28 and still create a good seal. Also, unlike an O-ring, a gasket 28 with flat sealing surfaces 59, 61 has no protruding feature that can buckle or displace under assembly/sealing forces. A flat gasket 28 is inexpensive to manufacture and where, as here, the only critical dimension is thickness, it is easy to maintain dimensional consistency during manufacturing.

As noted above, the examples shown and described do not limit the invention. Other examples may be made without departing from the scope of the invention, which is defined in the following claims.

What is claimed is:

1. Parts to be assembled into a fluid flow structure, comprising:

a first part having flat sealing surfaces each surrounding one of multiple first conduit openings;

a second part having sealing ridges each surrounding one of multiple second conduit openings; and a single gasket having multiple holes therethrough from a first side to a second side and flat sealing surfaces surrounding each hole on both sides, each hole positioned to align with a corresponding one of the first and second conduit openings so that, when the parts are assembled together with the gasket sandwiched between the parts, each sealing surface on the gasket contacts a corresponding one of the flat sealing surfaces on the first part or the sealing ridges on the second part, and fluid may flow through the holes in the gasket from the conduit openings on one of the parts to the conduit openings on the other part.

2. The parts of claim 1, wherein a cross-section of each sealing ridge includes a rounded apex and each flat sealing surface is configured to span the apex of a corresponding sealing ridge when the parts are assembled together.

3. The parts of claim 2, wherein the area of each flat sealing surface covers a misalignment tolerance between the first and second parts so that, when the parts are assembled together, each sealing ridge is always opposed by a flat surface.

4. The parts of claim 3, wherein:

each part includes a feature within each conduit configured to inhibit air bubbles blocking flow through the conduits; and the gasket includes a feature within each hole configured to inhibit air bubbles blocking flow through the holes.

5. A print bar structure, comprising:

a feature for mounting a printhead; and an assembly for carrying liquid to a printhead when the printhead is mounted to the printhead mounting feature, the assembly including:

a first part having an outlet from a first conduit;

a second part attached to the first part, the second part having an inlet to a second conduit aligned with the outlet from the first conduit; and a pliable gasket having flat surfaces sealing the two parts around the inlet and the outlet by a ridge on one of the parts and a flat on the other part.

6. The structure of claim 5, wherein:

the outlet from the first conduit comprises multiple outlets each from a corresponding one of multiple first conduits;

the inlet to the second conduit comprises multiple inlets each to a corresponding one of multiple second conduits aligned with one of the outlets from the first conduits; and the gasket comprises a single gasket sealing the two parts around the inlets and the outlets by ridges on one of the parts and flats on the other part.

7. The structure of claim 6, wherein the printhead mounting feature includes an exterior surface for attaching printheads to the print bar structure and the print bar structure also comprises:

an interior bay holding the liquid carrying assembly; and openings from the interior bay to the exterior printhead attach surface through which liquids may flow from the second conduits to printheads attached to the exterior surface when the printheads are attached to the print bar structure.

8. The structure of claim 6, wherein each ridge surrounds an inlet on the second part and each flat surrounds an outlet on the first part.

9. The structure of claim 5, wherein the flat and the gasket sealing surface sealed by the flat have a surface roughness less than 32 microinches.

10. A print bar structure, comprising:

an exterior feature having a printhead attach surface for attaching printheads to the print bar structure; and an interior feature holding a liquid distribution assembly for carrying liquid to the printheads when there are printheads are attached to the print bar structure, the liquid distribution assembly including:

a first part having first conduits, an outlet from each of the first conduits, and first surfaces each surrounding one of the outlets;

a second part attached to the first part, the second part having second conduits, an inlet to each of the second conduits aligned with the outlet from a corresponding first conduit, and second surfaces each surrounding one of the second conduits; and a pliable gasket between the first part and the second part, the gasket having holes therethrough each aligned with the outlet from a corresponding first conduit and the inlet to a corresponding second conduit, flat first sealing surfaces each contacting a corresponding first surface on the first part, and flat second sealing surfaces each contacting a corresponding second surface on the second part; wherein each one of the first surfaces or the second surfaces is flat and each of the other of the first surfaces or the second surfaces includes a ridge protruding into the gasket sealing surface.

11. The structure of claim 10, wherein a cross-section of each ridge includes a rounded apex and each flat surface spans the apex of a corresponding ridge.

12. The structure of claim 10, wherein:

each part includes a feature within each conduit configured to inhibit air bubbles blocking flow through the conduits; and the gasket includes a feature within each hole configured to inhibit air bubbles blocking flow through the holes.

* * * * *